US005090046A

United States Patent [19]

Friel

[11] Patent Number: 5,090,046

[45] Date of Patent: Feb. 18, 1992

[54] ANALYZER DETECTOR WINDOW AND A METHOD FOR MANUFACTURING THE SAME

[75] Inventor: John J. Friel, Furlong, Pa.

[73] Assignee: Outokumpu Oy, Helsinki, Finland

[21] Appl. No.: 439,476

[22] Filed: Nov. 21, 1989

[30] Foreign Application Priority Data

Nov. 30, 1988 [FI] Finland ..... 885554

[51] Int. Cl.[5] ..... H01J 5/18

[52] U.S. Cl. ..... 378/161; 250/385.1

[58] Field of Search ..... 378/161, 19, 140, 34, 378/35; 250/308, 385.1; 430/435, 320, 5

[56] References Cited

U.S. PATENT DOCUMENTS

| | | | |
|---|---|---|---|
| 3,296,478 | 1/1967 | Ichinokawa | 313/93 |
| 4,122,967 | 10/1978 | Rohrich | 378/161 |
| 4,862,490 | 8/1989 | Karnezos et al. | 378/161 |
| 4,933,557 | 6/1990 | Perkins et al. | 250/505.1 |
| 4,960,486 | 10/1990 | Perkins et al. | 156/647 |

FOREIGN PATENT DOCUMENTS

| | | |
|---|---|---|
| 0113168 | 7/1984 | European Pat. Off. . |
| 8600752 | 1/1986 | Fed. Rep. of Germany . |

OTHER PUBLICATIONS

Rimbert, J. N., Testard, O. A., "X-, B-ray Detector Windows of Compo . . . ", Apr. 21, '86, pp. 95-100.

*Primary Examiner*—Janice A. Howell
*Assistant Examiner*—Don Wong
*Attorney, Agent, or Firm*—Dellett, Smith-Hill and Bedell

[57] ABSTRACT

The invention relates to a detector window for an analyzer, particularly an X-ray analyzer, and to a method for manufacturing the same. The detector window is permeable to soft X-rays when the window is at least on one surface in contact with a pressure essentially equal to that of a vacuum. The detector window of the invention is a thin film, with the thickness of 0.5 μm, and is manufactured by means of photolitography.

18 Claims, No Drawings

ANALYZER DETECTOR WINDOW AND A METHOD FOR MANUFACTURING THE SAME

The present invention relates to the detector window of an X-ray analyzer, through which window the intensity formed by soft X-rays is measured. The invention also relates to a method for manufacturing the detector window.

Traditionally the window of an X-ray analyzer has been made of beryllium. This kind of window is necessary when the detector is not placed in a vacuum, as is the case with a scanning electron microscope, although the inner components of the apparatus are located in a vacuum. Owing to the low molar mass of beryllium, the detector window must, however, be at least 7 μm thick in order to create a sufficient twisting and mechanical strength.

In order to make the detector window of an X-ray analyzer thinner and thus better in operation, plastic materials have also been used in the production of detector windows. The U.S. Pat. No. 4,119,234 describes a vacuum-tight window made of plastic, such as polyimide. In the article *X-γ-β ray detector windows of composite material replacing beryllium in the* 4.2–420 *K. temperature range* by Rimbert J. N. and Testard O. A., *Nuclear Instruments and Methods in Physics Research A* 251 (1986), p. 95–100, the beryllium windows are replaced by windows formed of aluminium layers fitted in a laminated fashion between aligned polyimide membranes. Furthermore, from the U.S. Pat. No. 4,061,944 it is known to use polymer membranes by the trademarks Kapton or Mylar in the making of windows for electron beam generators.

The U.S. Pat. No. 3,262,002 introduces an X-ray detector where the windows are manufactured of various different materials such as nitrocellulose. Nitrocellulose has also been used in the electron microscope of the U.S. Pat. No. 2,241,432, comprising a window with a small area, which window can, however, be used in connection to a pressure difference of one atmosphere. This window is formed as a colloid containing nitrocellulose, while the window thickness is within the range of 0.1–1.0 μm.

The U.S. Pat. No. 3,319,064 relates to a slidable window system for an X-ray analyzer, wherein three windows are grouped together to be operated so that only two of the windows are operated simultaneously, and that they are interchangeable with two beryllium windows which prevent any pressure difference between the internal and external parts of the apparatus. Moreover, the window system includes one beryllium and one colloid window, which are insulated, due to the pressure difference, by means of the two preceding windows.

The purpose of the present invention is to realize an improved detector window for an analyzer for analyzing X-rays, particularly soft X-rays, which window is made of a thin polymer film and which endures the pressure difference between the internal and external parts of the analyzer without a specific protective structure.

The X-ray analyzer detector window of the present invention is made, by making use of photolithography, of polymer products sold under the trademarks PYRALIN or KAPTON. The PYRALIN product is composed, according to *The Encyclopaedia of Chemical Trademarks and Synonyms Vol. III*, of polyimide and glass fiber, whereas the KAPTON product, according to the *Thesaurus of Chemical Products Vol. II*, is a polyimide membrane. Particularly the polymer products PYRALIN PI 2555 and PYRALIN PI 2556 are well suited to the method of the present invention.

In order to manufacture the detector window of the X-ray analyzer of the present invention by means of photolithography, the required 25 μm thick metal plate is advantageously made of for example copper or copper alloy, such as brass, of tungsten, nickel or gold. In the beginning of the production process, the metal plate is subjected to supersonic cleaning by means of freon, whereafter the plate is washed by distilled water. The cleaned plate is then dried by blowing with an inert gas such as nitrogen, by heating the plate momentarily up to the temperature of 90° C. Onto the dried plate there is then applied, in order to improve the sticking of the polymer product proper, a layer of for instance silane, whereafter the polymer product forming the X-ray analyzer detector window of the invention can be spread onto the plate. Prior to the spreading of the polymer product, it is possible, if desired, to apply a thin layer with the thickness of 0.1–0.2 μm, made of diamond powder, boron nitride or boron carbide, in which case the final film is made gas-proof, for instance helium-proof.

The film material applied on the metal plate is further dried in the temperature of 350°–370° C. in a nitrogen atmosphere. Thereafter the plate, serving as the mask, is imaged, and the obtained image is etched off for instance by means of ferrichloride. The remaining product is a metal-framed polymer film with the thickness of 0.5 μm, suited to be used as a window. Because this detector window made by means of photolithography is permeable to visible light, the window is treated in order to make it impermeable to visible light. The treatment is carried out by applying onto at least one window surface a thin aluminum layer with the thickness of roughly $30\times10^{-10}$ m (=30 Ångströms).

The X-ray analyzer detector window manufactured according to the method of the present invention is advantageously suited to transmit and/or receive soft X-rays, the energy whereof is within the range of 100–1000 eV. Moreover, the detector window allows for a pressure difference larger than one atmosphere in between the interior parts of the analyzer and the environment. Thus the detector window can be used for example when the pressure inside the analyzer essentially corresponds to that of a vacuum, and the pressure in the exterior is one atmosphere, or even in an opposite case, when a gas pressure is formed inside the analyzer, and the analyzer itself is located within a vacuum. It is naturally obvious that the detector window can be used in circumstances where the pressure difference is below one atmosphere, or even when the pressure is equal on both sides of the window.

The material used in the detector window of the invention, which material contains polyimide or polyimide and glass fiber, is chemically inert and harmless to X-rays. Moreover, the detector window of the invention can be used in relatively high temperatures, up to the range of 300°–350° C. Furthermore, the method of the invention enables the production of a large detector window with a diameter of even 150 mm.

I claim:

1. A window member for an X-ray analyzer, for penetration by soft X-rays, said window member including polymer material, wherein the polymer material is present in the window member in the form of a single layer of polymer material about 0.5 micrometers thick.

2. A window member according to claim 1, being a two-layer member comprising, in addition to said single layer of polymer material, a film of aluminum about 3 nanometers thick adhered to one side of the single layer of polymer material.

3. A window member according to claim 1, further comprising a layer of non-polymer material adhered to one side of the single layer of polymer material, whereby the window member is rendered gas-proof.

4. A window member according to claim 3, wherein the material of said layer of non-polymer material is diamond powder, boron nitride or baron carbide, and the thickness of said layer of non-polymer material is 0.1 to 0.2 micrometers.

5. A window member according to claim 1, wherein the polymer material is polyimide.

6. A window member according to claim 5, comprising glass fiber incorporated in the polyimide.

7. A window member according to claim 1, wherein the window member is a three-layer member and further comprises, in addition to said single layer of polymer material, a film of aluminum about 3 nanometers thick adhered to each side of the single layer of polymer material.

8. A detector window for an X-ray analyzer, for penetration by soft X-rays, the detector window comprising a metal frame defining an aperture, and a single film of polymer material adhering to the metal frame and spanning the aperture defined thereby; wherein the detector window is constructed by a method comprising the following steps:

adhering a single thin film of polymer material about 0.5 micrometers thick to one surface of a layer of metal;

using photolithography to define an aperture region of the metal within a frame region of the metal; and etching away the aperture region of the metal.

9. A detector window according to claim 8, wherein the method of constructing the window further comprises, after the etching step, applying a layer of aluminum about 3 nanometers thick to at least one surface of the film of polymer material so as to render the window opaque to visible light.

10. A detector window according to claim 8, wherein the method of constructing the window comprises, before the adhering step, applying a layer of non-polymer material to said one surface of the layer of metal such as to render the window gas-proof.

11. A detector window according to claim 8, wherein the method of constructing the window comprises, before the adhering step, applying a thin layer of diamond powder, boron nitride or boron carbide about 0.1 to 0.2 micrometers thick to said one surface of the layer of metal.

12. A detector window according to claim 11, wherein the method of constructing the window further comprises, after the etching step, applying a layer of aluminum about 3 nanometers thick, to at least one surface of the film of polymer material so as to render the window opaque to visible light.

13. An improved X-ray analyzer window comprising a metal frame defining an aperture and a window member for penetration by soft X-rays, said window member being adhered to the metal frame and spanning the aperture and comprising polymer material, and wherein the improvement resides in that the polymer material is present in the window member in the form of a single layer of polymer material about 0.5 micrometers thick.

14. A window according to claim 13, wherein the window member is a two layer member and further comprises, in addition to said single layer of polymer material, a layer of aluminum about 3 nanometers thick adhered to at least one side of the single layer of polymer material.

15. A window according to claim 14, wherein the window member further comprises a layer of non-polymer material adhered to one side of the single layer of polymer material and whereby the window is rendered gas-proof.

16. A window according to claim 12, wherein the window member further comprises a layer of non-polymer material adhered to one side of the single layer of polymer material and whereby the window is rendered gas-proof.

17. A window according to claim 16, wherein the material of said layer of non-polymer material is diamond powder, boron nitride or boron carbide and the layer of non-polymer material is 0.1 to 0.2 micrometers thick.

18. A window according to claim 13, wherein the window member is a three-layer member and further comprises, in addition to said single layer of polymer material, a film of aluminum about 3 nanometers thick adhered to each side of the single layer of polymer material.

* * * * *